United States Patent [19]

Rasmussen

[11] 4,067,130

[45] Jan. 10, 1978

[54] SIGN BOARD CASING

[75] Inventor: Poul Rasmussen, Esbjerg, Denmark

[73] Assignee: Colorlux a-s, Esbjerg, Denmark

[21] Appl. No.: 738,962

[22] Filed: Nov. 4, 1976

[30] Foreign Application Priority Data

Nov. 14, 1975 Denmark ..... 5137/75

[51] Int. Cl.[2] ..... G09F 13/00

[52] U.S. Cl. ..... 40/563; 40/152.2; 40/574

[58] Field of Search ..... 40/152.2, 132 R, 130 R

[56] References Cited

U.S. PATENT DOCUMENTS

| | | | |
|---|---|---|---|
| 2,699,620 | 1/1955 | Smythe | 40/132 R |
| 3,419,986 | 1/1969 | Maze | 40/130 R |
| 3,423,865 | 1/1969 | Hardesty et al. | 40/130 R |

*Primary Examiner*—Russell R. Kinsey
*Assistant Examiner*—Wenceslao J. Contreras
*Attorney, Agent, or Firm*—Haseltine, Lake & Waters

[57] ABSTRACT

The invention relates to an oblong sign board casing comprising a reflector sheet provided with parallel embossings extending in planes substantially perpendicular to a longitudinal axis. The profiled reflector sheet is curved about 90° round a longitudinal axis, whereby a self-supporting construction is obtained. This construction renders it possible to provide the front plate with a flange and a sharp edge at the bottom. The embossings cause an effective diffusion of the light, also towards the bottom face.

2 Claims, 2 Drawing Figures

SIGN BOARD CASING

The present invention relates to a sign board casing comprising a reflector of profiled sheet, one or several light sorces such as fluorescent tubes mounted on said reflector, and a front plate mounted at the edges of the reflector, the profiling of the reflector sheet being substantially parallel embossings extending in planes substantially perpendicular to a longitudinal axis in the casing.

A display device is known comprising a profiled reflector sheet curved round several longitudinal axes.

The object of the invention is to provide a sign board casing being self-supporting and diffusing the light effectively, and furthermore comprising a sharp edge at the bottom and a plane bottom face capable of adjoining the wall to which the sign board casing is to be secured.

The sign board casing according to the invention is characterized by the profiled reflector sheet comprising two substantially plane zones substantially perpendicular to each other and a curved intermediate zone having a radius of curvature of 3 to 20 cm, and by the front plate being secured to the two plane reflector zones perpendicular to each other. This arrangement renders it possible to provide the front plate with a flange, since the total curvature of the reflector sheet thereby is about 90°. A total curvature of the embossed reflector sheet of about 90° has shown up to provide a sufficiently rigid construction, thus making the sign board casing self-supporting whereas the embossings cause an effective diffusion of the light towards the bottom face too. It is, of course, a labour-saving fact that only one curvature of the reflector sheet is necessary.

Figure 1:
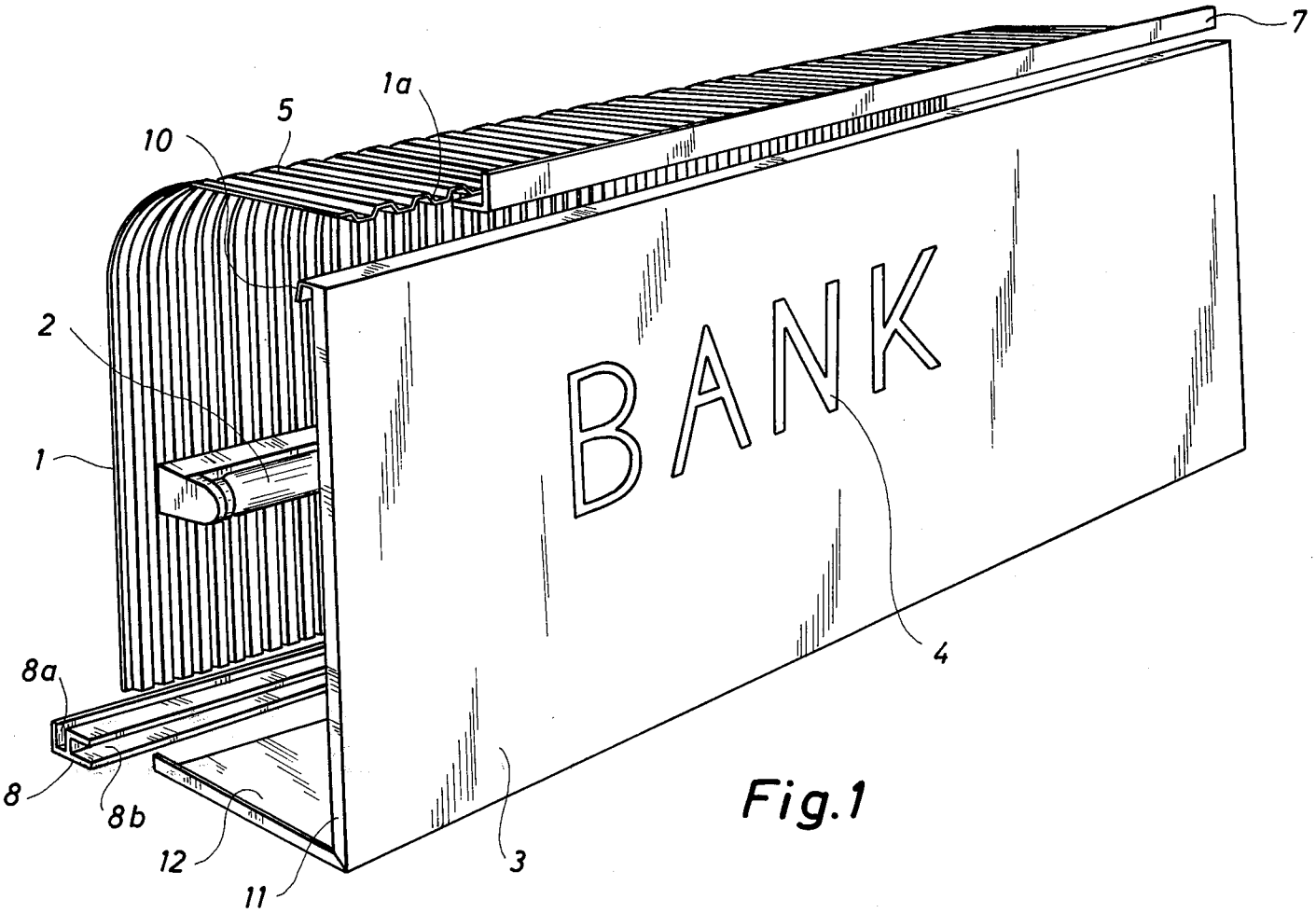

The invention will be described below with reference to the accompanying drawing, in which FIG. 1 illustrates a sign board casing according to the invention, and FIG. 2 one of the side plates of the sign board casing.

The sign board casing shown in FIG. 1 according to the invention comprises a refector 1, one or several light sources 2 such as fluorescent or neon tubes mounted on said reflector 1, and an aluminium sheet 3 mounted at the edges of the reflector 1, and bent at the bottom. The sign board casing thereby obtains a plate bottom face and a sharp edge in front at the bottom. The aluminium sheet 3 is transparent to light through apertures 4. The reflector 1 is an embossed sheet curved locally about 90° round one longitudinal axis in such manner that it comprises two substantially plane zones and a curved intermediate zone. Before the curvature the reflector 1 has been provided with a pattern of projections in the form of parallel embossing 5 having a substantially trapezoidal cross section. What with the strain-hardening during the actual embossing and the increased resisting moment of the embossings 5 the reflector 1 becomes rather rigid. A symmetric diffusion of light on the aluminium sheet 3 may be achieved by making the embossings 5 symmetric, i.e. by forming the embossings as isosceles trapeziums. When the embossings 5 are arranged sufficiently close to each other a completely uniform diffusion of light is achieved. A distance of 30 mm between the parallel symmetry planes in the trapezoidal embossings 5 has shown up to be sufficiently small. The ratio of this distance to the height of the trapeziums 5 may for instance be 1:4. The height in the illustrated embodiment is 6 mm. The trapezoidal embossings are easy to provide by means of an embossing tool, i.e. by gradual feed of the unmachined sheet.

The sign board casing comprises joints 7, 8 for the securing of the aluminium sheet 3 to the edges of the two substantially plane reflector zones perpendicular to each other. The lower joint 8 is an edge fillet having two longitudinal grooves 8*a*, 8*b* perpendicular to each other. The second joint 7 is an angle section secured to the upper edge 1*a* of the reflector 1 turning upwards and thereby supporting the aluminium sheet 3, said aluminium sheet 3 comprising a downward flange 10, meshing with the angle section, along its upper edge. These joints 7, 8 facilitate the assembling of the components of the sign board casing. The thickness of the reflector 1 is about 0.7 mm. This thickness presenting the illustrated trapezoidal embossings 5 has proved to be sufficiently thick for achieving the necessary rigidity. A thicker sheet is somewhat harder to work in, and will only increase the weight of the reflector 1 without increasing the rigidity considerably. The reflector 1 may advantageously be of aluminium.

An acrylic sheet 11 may be situated behind the aluminium sheet 3. The effect of this arrangement is a diffusion of light at the apertures 4 of the aluminium sheet 3, of FIG. 1, whereby the sign board casing will serve as a modern neon system.

The aluminium sheet 3 may be a brown or a black electrolytically refined aluminium sheet providing an exclusive character.

The aluminium sheet may be divided into several pieces. A dark knurling may be arranged for every 25, 50, or 75 cm.

Figure 2:
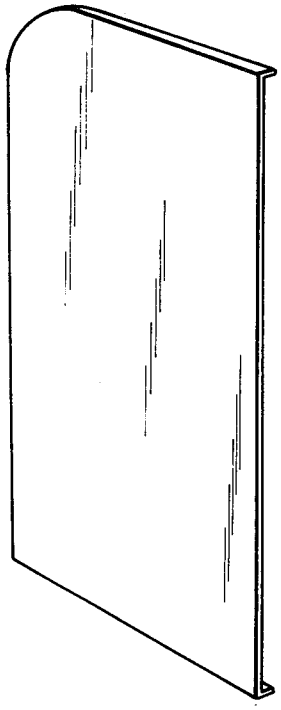

The sign board casing is on its sides provided with side plates, of FIG. 2. These plates may also be of electrolytically refined aluminium.

The radius of curvature of the curved intermediate zone is preferably 3 to 20 cm.

The reflector may be provided with the desired length on the spot since it is easy to saw off.

If the front plate of the known display device was provided with a curvature of 90° in order to achieve a sharp edge at the bottom and a plane bottom face, the back of the display device would in consequence of a total curvature of the reflector of about 180° be unsecurable to a wall in such manner that the bottom face mentioned adjoins the wall.

I claim:

1. A self supporting illuminated sign casing defined by a reflector of corrugated sheet, diffusing light means employing one or several light sources such as fluorescent tubes, said light sources being mounted on said reflector, and a front plate mounted at the edges of the reflector, the corrugations of said reflector sheet being substantially parallel embossings extending in planes substantially perpendicular to a longitudinal axis, said casing including: said corrugated reflector sheet comprising two substantially plane zones substantially perpendicular to each other and a curved intermediate zone having a radius of curvature of 3 to 20 cm, and by the front plate being secured to the two plane reflector zones perpendicular to each other, said front plate being further defined by a bottom portion with flange means and a sharp edge to enable placement of said sign board casing in adjoining relation to a proximate surface.

2. A sign casing as claimed in claim 1, wherein the embossings having a substantially trapezoidal cross section.

* * * * *